US005902222A

United States Patent [19]

Wessman

[11] Patent Number: 5,902,222

[45] Date of Patent: May 11, 1999

[54] METHOD AND APPARATUS FOR GUIDING AND FORMING A THIN WEB MATERIAL

[75] Inventor: Bo Wessman, Eslov, Sweden

[73] Assignee: Tetra Laval Holdings & Finance S.A., Pully, Switzerland

[21] Appl. No.: 08/809,924

[22] PCT Filed: Oct. 3, 1995

[86] PCT No.: PCT/SE95/01127

§ 371 Date: Jun. 23, 1997

§ 102(e) Date: Jun. 23, 1997

[87] PCT Pub. No.: WO96/11871

PCT Pub. Date: Apr. 25, 1996

[30] Foreign Application Priority Data

Oct. 12, 1994 [SE] Sweden ..... 9403467

[51] Int. Cl.[6] ..... B31F 1/22

[52] U.S. Cl. ..... 493/439; 493/417; 493/19; 493/442; 270/40; 270/41

[58] Field of Search ..... 270/41, 40; 198/810.03, 198/806; 493/19, 20, 29, 34, 416, 417, 436, 438, 446, 455, 476, 439, 440, 442, 443, 445

[56] References Cited

U.S. PATENT DOCUMENTS

| | | | |
|---|---|---|---|
| 1,305,129 | 5/1919 | Lange | 493/439 |
| 2,023,734 | 12/1935 | Lamatsch | 493/439 |
| 2,072,815 | 3/1937 | Heygel | 270/41 |
| 2,741,079 | 4/1956 | Rausing | 53/551 |
| 3,111,310 | 11/1963 | Dutro et al. | 493/439 |
| 3,165,310 | 1/1965 | Peterson | 493/439 |
| 3,368,665 | 2/1968 | Jinkins | 198/806 |
| 3,482,491 | 12/1969 | Gustafson | 493/302 |
| 3,922,835 | 12/1975 | Reil | 53/167 |
| 4,081,944 | 4/1978 | Sjöstrand | 53/51 |
| 4,151,024 | 4/1979 | Ohlsson | 156/69 |
| 4,266,993 | 5/1981 | Olsen | 156/69 |
| 4,285,686 | 8/1981 | Ambler | 493/476 |
| 4,332,458 | 6/1982 | Hoffman | 198/806 |
| 4,698,514 | 10/1987 | Hilmersson et al. | 250/566 |
| 4,782,987 | 11/1988 | Giacomelli et al. | 226/2 |
| 5,016,863 | 5/1991 | Birkmair | 270/41 |
| 5,137,505 | 8/1992 | Ishii et al. | 493/439 |
| 5,178,601 | 1/1993 | Lovenbrant | 493/423 |
| 5,471,289 | 11/1995 | Satoh et al. | 198/806 |

FOREIGN PATENT DOCUMENTS

| | | |
|---|---|---|
| 25 03 701 B2 | 1/1977 | Germany . |
| 41 31 653 A1 | 3/1993 | Germany . |
| A 428267 | 5/1935 | United Kingdom . |
| A 1177241 | 1/1967 | United Kingdom . |

*Primary Examiner*—William E. Terrell
*Assistant Examiner*—Patrick Mackey
*Attorney, Agent, or Firm*—Burns, Doane, Swecker & Mathis, L.L.P.

[57] ABSTRACT

The invention relates to a method and apparatus for guiding a thin web material while folding the web material over a triangular former. The apparatus includes two guide rolls over which the web material is driven. The second guide roll is secured to a baseline of the triangular former. The triangular former and the guide roll may be tilted back and forth about a longitudinal axis of a bearing axle extending through a tip of the triangular former. The longitudinal axis is parallel with the web material extending between the two guide rolls. The position of the triangular former is controlled by a non-contacting edge scanning member that scans the position of the web material on the guide roll and causes the adjustment device to tilt the guide roll and the triangular former to ensure that the edges of the folded web material are precisely aligned.

11 Claims, 3 Drawing Sheets

METHOD AND APPARATUS FOR GUIDING AND FORMING A THIN WEB MATERIAL

TECHNICAL FIELD

The present invention relates to a method and apparatus for guiding and folding a thin web material.

BACKGROUND AND SUMMARY OF THE INVENTION

The present invention is a method for guiding a thin web material to form or fold the thin web material. The unformed web material is conveyed over a first and second guide roll. The shape of the web material is then formed over a triangular former and forming rolls.

The present invention also relates to an apparatus for guiding and forming the thin web material. The apparatus includes a first and second guide roll, a triangular former and two forming rolls.

It is a generally known principle that in forming a thin web material, such as a plastic material, the web material is conveyed over a triangular former. This method is, for example, used to make bags and similar products when it is desirable to fold a single web material. The method may briefly be described as passing the web material over a baseline side edge of the triangular former and then folding the web material when the web material reaches the opposite corresponding tip of the triangle. The folder web material is thereafter usually guided between forming rolls that convey the web material forward for further processing.

The unfolded web material may be unevenly wound on a supply roll, unevenly cut or unevenly conveyed through the apparatus. This results in the edges of the web material not being exactly aligned when the web material is folded. Depending on the application, this deficiency may be adjusted for by using a wide joint where the edges are sealed together or the protruding sealed edges may be cut from the folded web material. This method is used when bags are manufactured. For other applications, such as folding of textiles, it does not matter whether the edges are exactly aligned.

To be able to exactly align the edges when web material is folded, some sort of guidance of the web material is required to adjust for the problems mentioned above. The edges must be aligned with high precision when, for example, package materials are made where the sealed joint is located at the outside of the package. To make the package material aesthetically appealing, it is desirable to align the edges with as high a precision as possible. Another advantage of guiding the edges so that they are perfectly aligned is that the material cost is reduced and a much more narrow joint may be used where the edges are sealed.

An object of the present invention is to provide a method and an apparatus to guide a thin web material to adjust for: misaligned conveyance of the web material through the apparatus, uneven winding of the web material or unevenly cut web material.

A further object of the present invention is to provide a method and apparatus for guiding a web material so that the difference between the length of the generatrices of the side edges and the center line of the web material is very small.

A further object of the present invention is to provide a method for folding a thin web material so that machine costs may be reduced because the requirements of precise guidance of the web material through the machine are reduced.

These and other objects are achieved by the method of the present invention because the triangular former, whose baseline is secured to the second guide roll, may be tilted back and forth about a longitudinal axis of a bearing axle extending through the tip of the triangular former that is opposite the baseline of the former. The longitudinal axis is parallel to the web material when the web material is conveyed between the first and the second guide roll. The tilting of the triangular former is dependent upon a noncontacting scanning device that scans at least one of the edges of the web material.

These and other objects have also been achieved by the apparatus of the present invention because the baseline of the triangular former is secured to the second guide roll and the triangular former and the second guide roll are movably attached to the apparatus so that they may be tilted relative to the longitudinal axis that extends through the tip of the triangle so that this longitudinal axis is parallel with the web material when the web material is conveyed between the first and second guide roll. The apparatus also includes a member that is secured to the second guide roll for noncontacting scanning of the edges of the web material. The member is arranged to control the position of the triangular former and the second guide roll.

The preferred embodiments of the present invention are further described in the claims.

BRIEF DESCRIPTION OF THE DRAWINGS

The preferred embodiments of the present invention are now described in greater detail as shown by the attached figures as follows.

The drawings only show the important details of the present invention to provide a sufficient understanding thereof.

DETAILED DESCRIPTION

A web material 1, for which the method and apparatus may be used, may be in the form of a thin plastic material such as polyethylene (PE) or polyester (PET). The web material 1 may also be a thin plastic foil that is laminated with a thinner form of paper or metal foil. In the alternative, the web material 1 may be of different plastics that are laminated to one another. Other flexible plastic and non-plastic materials may also be used.

Figure 1:
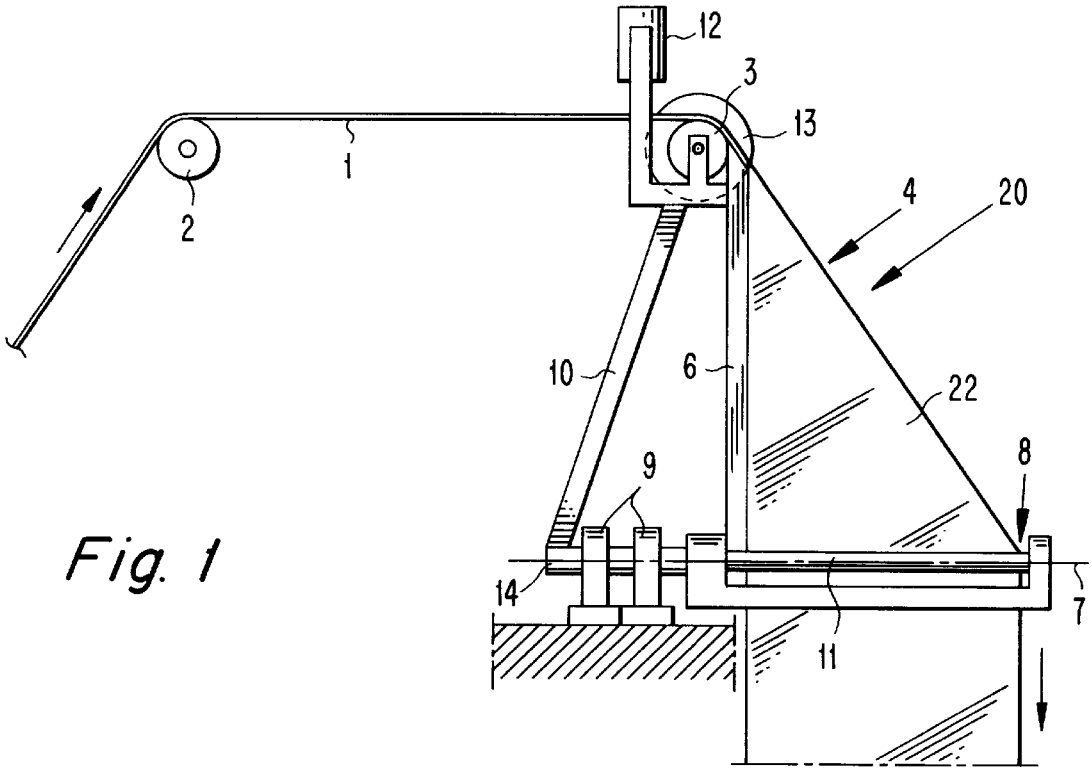
FIG. 1 shows a side view of a portion of the apparatus of the present invention.

FIG. 1 shows a side view of an apparatus 20 wherein the web material 1 is conveyed from a supply roll (not shown). The unformed single web material 1 is thus guided or passed over a first guide roll 2 and over a second guide roll 3. The distance D between the guide rolls 2, 3 is preferably about the same as the width W of the web material 1 of the preferred embodiment.

A triangular former 4 has one side, hereinafter called a baseline 5, that is secured to the second guide roll 3 along most of the length of the guide roll 3. In the preferred embodiment, the triangular former 4 constitutes one side of a tetrahedron 22. This tetrahedron 22 has at least two additional sides 6 (one of which is shown in FIG. 1). By designing the triangular former 4 as one side in a tetrahedron, having at least two additional sides 6, the web material 1 is supported by the sides 6 during the folding process of the web material 1. From a hygienic view-point, it is preferable to provide the tetrahedron 22 with all four sides of the tetrahedron when packaging material for packaging of food is folded. This closed tetrahedron is easier to clean. The side of the tetrahedron 22 which represents the triangular former 4 is, in the preferred embodiment, an almost equilateral triangle on which the folding of the web material 1 is performed. Obviously, triangular formers having an acute angle or an obtuse angle at the tip 8 may be used. However, an acute angle in the triangular former 4 makes the triangular former 4 longer which is a drawback because it is desirable that the apparatus, to be built into an existing machine, should be as compact as possible. An obtuse angel at the tip 8 means that the triangular former is shorter and the web material 1 is folded tighter against edges 24, 26 of the triangular former 4. This may result in undesirable tensioning of the web material 1.

The triangular former 4, together with the second guide roll 3 secured thereto, is disposed along a longitudinal axis 7 of a bearing assembly extending through the tip 8 of the triangular former 4. The tip 8 is the tip of the angle of the triangular former 4 that is opposite the baseline 5 of the triangular former 4. The bearing assembly may include a conventional bearing such as a roll, ball or glide bearing 9 and a bearing axle 14 rotatably attached to the bearing 9. The line 7 is the longitudinal axis of the bearing axle 14 and is parallel with the center line C of the web material 1 when the web material extends or travels between the first guide roll 2 and the second guide roll 3. If the longitudinal axis 7 of the bearing axle 14 is not parallel with the web material 1, extending between the two guide rolls 2,3, the difference between the length of the generatrices of the edges 24, 26 of the web material 1 and the longitudinal axis 7 is rapidly increased when adjustments are made to compensate for deviations of the sideways position of the web material 1 on the guide roll 3. This results in tension in the web material 1 which in turn may result in a crease in the web material even when adjustments are made for small variations of the side position of the web material 1 as the web material 1 travels over the guide roll 3. As shown in FIG. 1, the bearing axle 14 of the triangular former 4 is attached to the guide roll 3 by a bar 10. In this way, the triangular former 4 and the guide roll 3 are together tiltable about the longitudinal axis 7 of the bearing axle 14 so that the triangular former 4 and the guide roll 3 may be tilted in both directions about the longitudinal axis 7 as the bearing axle 14 is rotated within the bearing 9.

In the preferred embodiment of the present invention, two forming rolls 11 are parallel to the bearing axle 14 of the triangular former 4 and positioned at the same elevation as the tip 8. The forming rolls 11 are preferably attached to the bearing axle 14. The forming rolls 11 receive the folded web material I from the triangular former 4 and convey the web material 1 forward into the machine or possibly onto a storage roll (not shown) for further processing.

The forming rolls 11 may be replaced by a type of glide rail or another type of stationary roll that receives and completes the folding process of the web material 1 on the triangular former 4. In the preferred embodiment, the forming rolls 11 are positioned on each side and parallel with the longitudinal axis 7 so that the apparatus 20 is as compact as possible and so that the folding may be completed close to the triangular former 4. The forming rolls 11 are also attached to the triangular former 4 and therefore movable with the triangular former 4 so that the forming rolls 11 may be positioned as close to the triangular former 4 as possible.

In the alternative, the bearing axle 14 and thus the longitudinal axis 7, about which the triangular former 4 and the second guide roll 3 may be tilted, may be positioned along an imaginary line extending from the middle of the baseline 5 through the tip 8 of the triangular former 4. The folded web material 1, placed between the baseline 5 and the tip 8 of the triangular former 4, may move perpendicularly sideways when the triangular former 4 is tilted about the longitudinal axis 7. If the longitudinal axis 7 is too close to the baseline 5 of the triangular former 4, the angle of rotation of the triangular former 4 and the second guide roll 3 will increase when any adjustment is made to compensate for deviations of the sideways position of the unformed web material 1 driven over the guide roll 3. This may result in increased tension at the edges 24, 26 of the web material 1. If the longitudinal axis 7 is placed outside the tip 8 of the triangular former 4, two pairs of forming rolls 11 are required. One pair of forming rolls 11 is placed at the tip 8 of the triangular former 4 and the other pair is positioned with the bearing axle 14. Such placements of the longitudinal axis 7 would require a longer and bulkier apparatus but may be used if a lower tension in the edges of the web material is desired. This is because the angle of rotation is smaller when a certain deviation of the side position of the web material is adjusted for. The longitudinal axis 7 may be placed outside the tip 8 of the triangular former if it is desirable to reduce the distance between the two guide rolls 2,3 while maintaining a maximum tension at the edges of the web material 1 when adjustments are made to compensate for certain deviations of the side position of the web material 1 as the web material 1 travels over the guide roll 3.

The apparatus 20 further includes a member 12 for non-contacting scanning of the edges 24, 26 of the web material 1. The scanning of the edges must be non-contacting because the edges 24, 26 of the web material 1 are relatively soft and stretchable which may make mechanical contact very destructive during the scanning process. The edge-scanning member 12 includes at least one non-contacting edge scanner, and the preferred embodiment includes two non-contacting edge scanners, which may be ultrasound emitters or photocells. If the web material 1 is crystal clear and transparent, an ultra sound emitter is preferred. However, if the web material is coated or coloured, photocells may be used. Alternatively, other forms of scanners such as pneumatic scanners with analog signals may be used. The edge scanner members 12 should be firmly attached to the triangular former 4 and the second guide roll 3. The edge scanner members 12 may be positioned immediately before the web material 1 reaches the second guide roll 3 so that the members may determine the side position of the web material 1 relative to the second guide roll 3 and the triangular former 4.

The two scanning members 12 provide a signal to a regulator or to another form of regulating device to control an adjustment device 13. The adjustment device 13 may be mechanical, pneumatic of hydraulic. In the preferred embodiment, the device 13 may be attached to one end of the guide roll 3, to push and pull the guide roll 3 and thus the triangular former so that they tilt about the longitudinal axis 7. The rotation about the longitudinal axis 7 may also be achieved by rotating the bearing axle 14. This rotation may be controlled by the edge scanning members 12.

Figure 2:
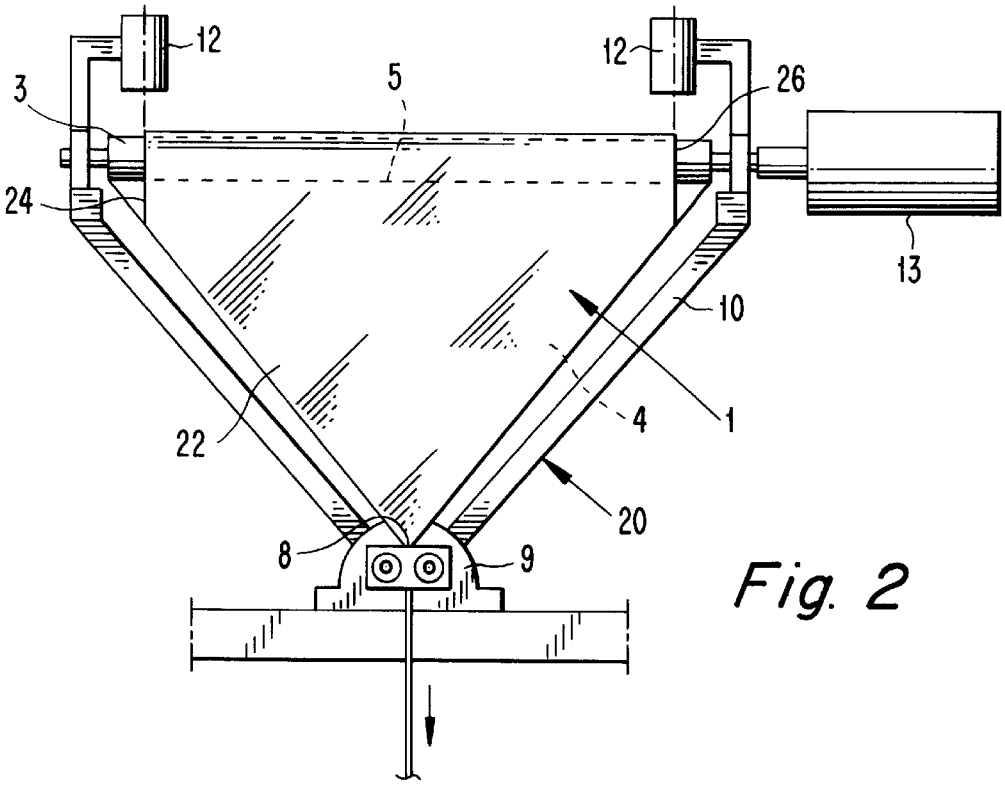
FIG. 2 shows another side view of a portion of the apparatus in FIG. 1.
Figure 3:
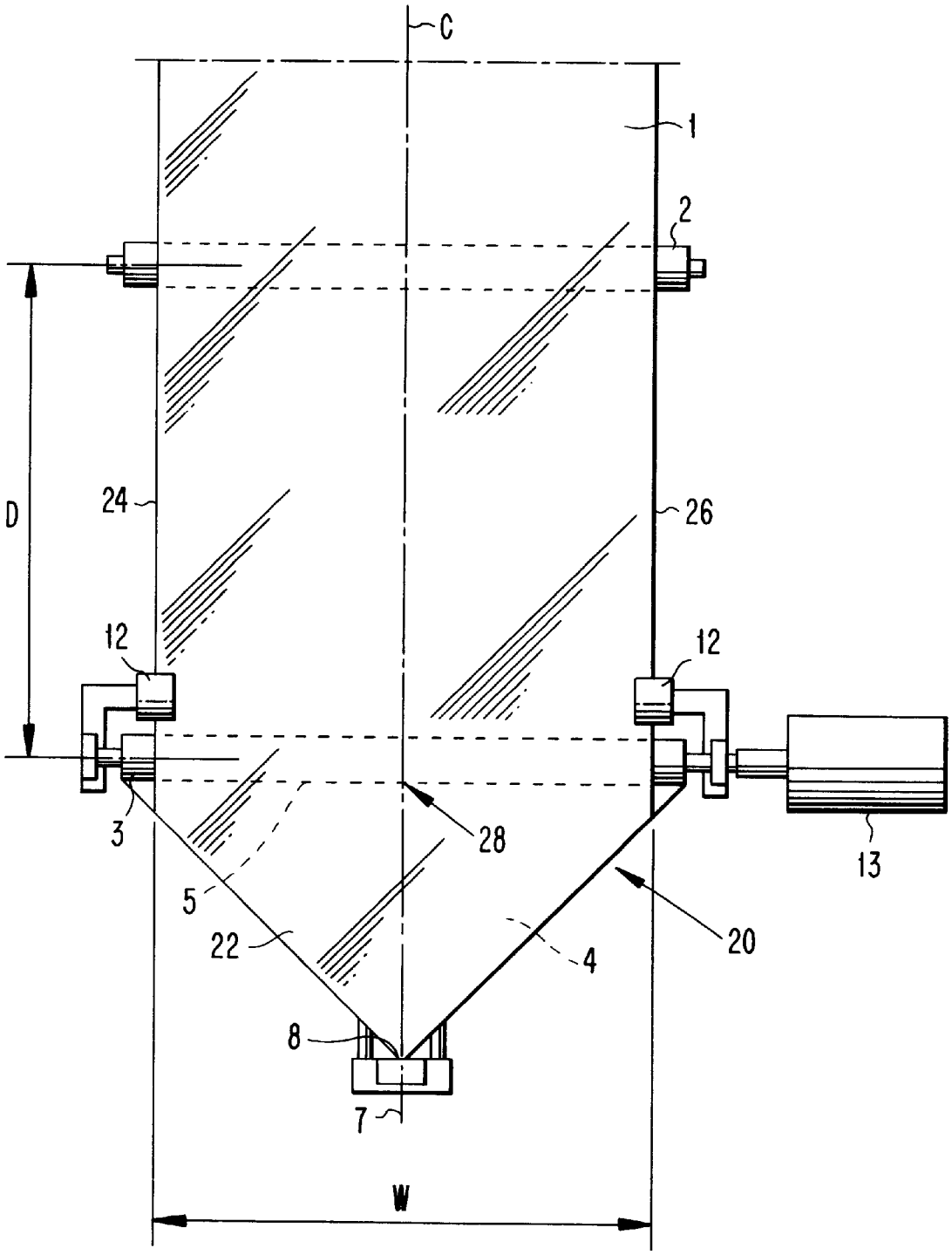
FIG. 3 shows a top view of the apparatus in FIG. 1.
Figure 4:
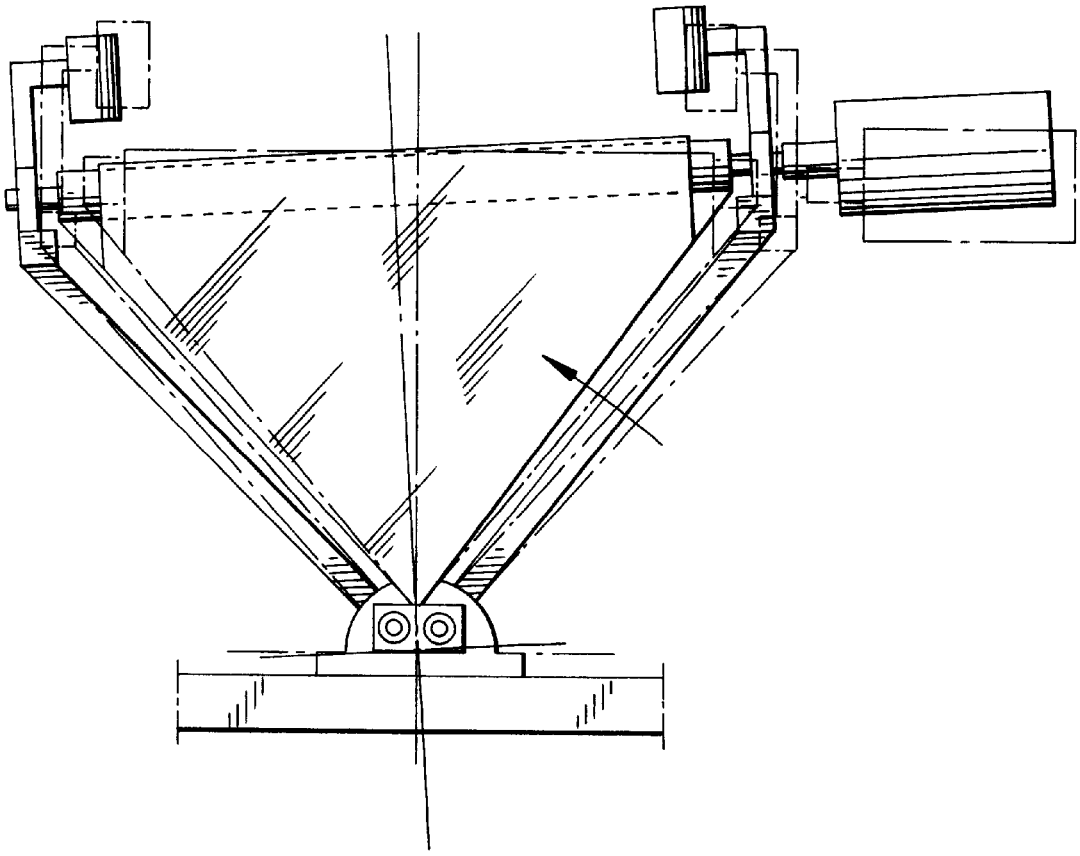
FIG. 4 shows the forming device in FIG. 2 pivoted.

As shown in FIGS. 1 and 2, the web material 1 is conveyed over the first guide roll 2 and forwarded to the second guide roll 3 and then onward over the triangular surface of the triangular former 4. Before the web material 1 reaches the second guide roll 3, the edge or the edges of the web material 1 are scanned to determine the sideways position of the web material on the second guide roll 3. The position of the edges of the web material 1 on the guide roll 3 may vary sideways due to uneven winding of the web material 1 on a supply roll, inexact pulling to the web material 1 through the apparatus 20 or uneven cutting of the web material 1. The scanned information about the position of the edges 24, 26 is sent to a regulator which in turn sends a signal to the adjustment device 13 in order to adjust for any deviation of the position of the edge of the web material 1 on the guide roll 3 as the web material 1 is passed through the apparatus 20. The adjustment device 13 may move the second guide roll 3, and thus the triangular former 4, back and forth to tilt the guide roll 3 and the triangular former 4 about the longitudinal axis 7 that extends through the tip 8 of the triangular former 4. In this way, the web material 1 is tilted between the guide rolls 2,3 and the distance between the guide rolls 2,3 should be the same as the width W of the web material 1. Experiments and calculations have shown that this tilting only produces a negligible amount of tension in the edges 24, 26 of the folded web material 1.

The process of forming a plane web material 1 to a folded web material 1 over a triangular former 4, according to the present invention, is characterized by the precise alignment of the edges of the web material 1 because a center line C of the web material is aligned with a mid-point 28 of the base line 5 of the triangular former 4. By tilting the second guide roll 3 and the triangular former 4, the mid-point 28 of the baseline 5 is moved so that it is always aligned with the center line C of the web material 1 regardless of whether there is any deviation of the side position of the single unfolded web material 1 and it does not affect the side position of the web material 1. Because the forming rolls 11 are secured to and move together with the triangular former 4, the folded web material 1 may always be bent over the forming rolls 11 independent of any adjustments of the side position of the web material 1.

With the above described method, it is possible to adjust for relatively large deviations of the position of the web material 1 partly depending on which material is used for the web material. A web material made of PE is soft and stretchable and can be adjusted more than a web material of PET which is slightly stiffer and less stretchable. The web material must be under sufficient tension as it goes through the apparatus so that a certain friction is generated against the guide rolls 2,3. Insufficient tension of the web material produces, when large deviations are adjusted for, pressure tensions in the middle of the web material 1 and pulling tensions at the edges of the web material 1. Too much tension of the web material 1 may mechanically affect the web material 1 and further tension may break the web material. Thus, the web material 1 must be applied against the guide rolls 2,3 so that a certain friction is produced to prevent the web material from gliding sideways when it travels over the guide rolls 2,3.

As is shown by the above description of the method and apparatus of the present invention, the invention provides a simple way to guide a thin web material while the web material is folded over a triangular former. By using the above described method and apparatus, the web material may be folded so that both edges are precisely aligned and the apparatus makes it possible to adjust the position of the web material on the guide roll sideways to compensate for relatively large deviations in the web material itself or its position on the guide roll.

While the present invention has been described with reference to preferred embodiments, it is to be understood that certain substitutions and alterations may be made thereto without departing from the spirit and scope of the invention as set forth in the appended claims.

I claim:

1. A method for guiding a thin web material having opposite side edges, the method comprising the steps of:

providing an apparatus having a first guide roll and a second guide roll, the apparatus further including a triangular former having a base line attached to the second guide roll and a tip, a bearing axle having a longitudinal axis that is parallel to a center line extending between the first and second guide rolls, the tip being positioned along said bearing axle longitudinal axis, the bearing axle being rotatably attached to a bearing, the apparatus further including a pair of forming members attached to the bearing axle, an adjustment device connected to the second guide roll, and a scanner attached to the apparatus;

driving the web material over the first and second guide rolls;

non-contacting scanning by the scanner of the position of the edges of the web material placed on the second guide roll;

sending a signal from the scanner to the adjustment device;

tilting the second guide roll and the triangular former about the longitudinal axis based on the signal sent by the scanner;

folding the web material on the triangular former to align the edges of the web material; and passing the folded web material between the forming means.

2. The method according to claim 1, wherein the web material has two opposite edges and the step of tilting the triangular former aligns the edges of the material when the web material is folded on the triangular former.

3. An apparatus for guiding a thin web material therethrough comprising:

a first guide roll, a second guide roll, a triangular former having a base line and a tip, the base line being secured to the second guide roll, the triangular former and the second guide roll being attached to the apparatus;

a bearing axle attached to the apparatus and having a longitudinal axis, the triangular former and the second guide roll being tiltable back and forth about the longitudinal axis;

a web material adapted for travelling over the first and second guide rolls and the triangular former, the web material having an edge, the longitudinal axis being parallel to the web material when the web material travels between the first and second guide rolls; and a member attached to the second guide roll for non-contacting scanning of the edge of the web material to control movements of the triangular former and the second guide roll.

4. An apparatus according to claim 3, wherein the apparatus comprise s forming means secured to the triangular former, said forming means being adapted to guide therebetween the web material folded by the triangular former.

5. An apparatus according to claim 4, wherein the forming means are a pair of forming rolls.

6. The apparatus according to claim 3, wherein the triangular former is one side of a tetrahedron having at least two additional sides.

7. The apparatus according to claim 3, wherein the member is adapted for non-contacting edge scanning to control an adjustment device that is attached to one end of the second guide roll.

8. The apparatus according to claim 7, wherein the apparatus has two members adapted for non-contacting edge scanning, the members being positioned at each of the edges of the web material.

9. The apparatus according to claim 3, wherein the first guide roll is located a distance from the second guide roll, the distance being of substantially the same length as the width of the web material.

10. An apparatus for folding a web material comprising:

a first guide roll attached to the apparatus;

a second guide roll attached to the apparatus;

a triangular former attached to the apparatus and having a base line and a tip, the base line being secured to the second guide roll;

a bearing axle in rotatable engagement with the apparatus and having a longitudinal axis, the triangular former and the second guide roll being tiltable about the longitudinal axis;

a web material adapted to travel over the first and second guide rolls and the triangular former, the web material having an edge, the longitudinal axis being parallel to the web material when the web material travels over the first and second guide rolls; and a scanner attached to the second guide roll for non-contacting scanning of the edge of the web material to control tilting movements of the triangular former and the second guide roll.

11. An apparatus for folding a single web material comprising:

a first guide roll;

a second guide roll, the second guide roll being a first distance from the first guide roll;

a triangular former having a base line attached to the second guide roll and a tip remote from the base line, the triangular former having a shape of a tetrahedron;

a bearing axle having a longitudinal axis;

a bearing rotatably attached to the bearing axle, the bearing being secured to the apparatus;

a flexible single web material adapted for travelling over the first and second guide rolls and over the triangular former to fold the web material, the web material having opposite side edges, the web material being parallel to the longitudinal axis of the bearing axle when the web material is travelling over the first and second guide rolls, the web material having a width that is substantially similar to the first distance between the first and second guide rolls;

a pair of forming rolls attached to the bearing axle and the triangular former, the forming rolls adapted to receive the folded web material therebetween;

a non-contacting scanner adapted to scan information about the position of the edges of the web material on the second guide roll; and an adjustment device in communication with the scanner, the adjustment device being attached to the second guide roll and adapted to tilt the second guide roll and the triangular former about the bearing axle based on the scanned information communicated by the scanner so that the edges of the web material are aligned when folded by the triangular former.

* * * * *